United States Patent [19]

Hinata et al.

[11] 3,955,996

[45] May 11, 1976

[54] METHOD FOR SPECTRALLY SENSITIZING PHOTOGRAPHIC LIGHT-SENSITIVE EMULSION

[75] Inventors: Masanao Hinata; Masanaga Ohki; Haruo Takei; Yuji Mihara, all of Minami-ashigara, Japan

[73] Assignee: Fuji Photo Film Co., Ltd., Minami-ashigara, Japan

[22] Filed: Nov. 15, 1974

[21] Appl. No.: 524,185

[30] Foreign Application Priority Data

Nov. 15, 1973 Japan ..... 48-128755

[52] U.S. Cl. ..... 96/129; 96/130; 96/131; 96/132; 96/133; 96/137

[51] Int. Cl.[2] ..... G03C 1/24; G03C 1/16

[58] Field of Search ..... 96/120, 130, 129, 131, 96/132, 133, 137

[56] References Cited

UNITED STATES PATENTS

| | | | |
|---|---|---|---|
| 3,482,981 | 12/1969 | Van Lare | 96/120 |
| 3,485,634 | 12/1969 | Owen et al. | 96/120 |
| 3,822,135 | 7/1974 | Sakai et al. | 96/120 |

*Primary Examiner*—J. Travis Brown

*Attorney, Agent, or Firm*—Sughrue, Rothwell, Mion, Zinn & Macpeak

[57] ABSTRACT

A method for spectrally sensitizing a photographic light-sensitive emulsion, which comprises dissolving a photographic spectrally sensitizing dye having an amidinium ion auxochrome in an organic solvent containing a substantially water-free acid having a pKa not exceeding about 5, and adding this dye-containing acid-organic solvent solution to a light-sensitive emulsion.

5 Claims, No Drawings

METHOD FOR SPECTRALLY SENSITIZING PHOTOGRAPHIC LIGHT-SENSITIVE EMULSION

BACKGROUND OF THE INVENTION

1. Field of the Invention

The present invention relates to an improved method for spectrally sensitizing a photographic light-sensitive emulsion necessary for the production of a photographic light-sensitive material and, more particularly, it relates to an improved method for spectral sensitization which can be achieved by effectively adding a dye to an emulsion.

2. Description of the Prior Art

In the production of photographic light-sensitive materials, it is well-known that spectral sensitization (i.e., expanding the light-sensitive wave-length region of a light-sensitive material to the visible region) is important and is indispensable for color light-sensitive materials.

Generally speaking, the spectrally sensitizing steps lie in dyeing light-sensitive elements dispersed in a photographic light-sensitive emulsion, such as silver halide fine crystals, zinc oxide, cadmium sulfide, titanium oxide fine crystals, etc., organic silver complexes, organic high polymer photoconductors, etc., by adding suitable dyes. In particular, many techniques have been developed with respect to methods for spectrally sensitizing silver halide. In the addition of a spectrally sensitizing dye to a silver halide emulsion, the adsorption state on the surface of silver halide fine crystals changes greatly depending upon the addition conditions, which seriously influences the photographic actions such as fogging action, light sensitivity, spectral sensitivity distribution, desensitizing action, stability of sensitivity, etc. This is described in detail in C. E. K. Mees; *The Theory of the Photographic Process*, 2nd. Ed., Chapter 12, pp.430 – 500, MacMillan Co. (1954). An important condition of providing a stable spectral sensitization while maintaining high sensitivity is that every molecule of the spectrally sensitizing dye added reaches an adsorption site on the light-sensitive silver halide crystals in a stable manner and is adsorbed there without seriously interacting with a binder and without aggregation and precipitation thereof. Also, it is important that the spectrally sensitizing dye is uniformly adsorbed on every light-sensitive silver halide crystal dispersed in the light-sensitive emulsion.

Many methods are known for adding a spectrally sensitizing dye to a light-sensitive photographic emulsion. One method of adding a sensitizing dye as an aqueous solution whose pH has been adjusted to about 6 to 7.5 with a base is described in Japanese Patent Publication No. 27555/69. Also, a method comprising dissolving a spectrally sensitizing dye in a volatile organic solvent having low solubility in water, adding this solution to a hydrophilic colloid for mixing, and heating the resulting mixture to remove the solvent is described in U.S. Pat. No. 3,469,987. In addition, a method of dispersing a substantially water-insoluble, spectrally sensitizing dye in a water-soluble organic solvent without dissolution is described in Japanese Patent Publication No. 24185/71. Further, in a method well-known in the photographic field, a dye is dissolved in a water-soluble organic solvent (e.g., methanol, ethanol, acetone, methyl cellosolve, etc.), and then added to an emulsion. In some cases, water is partly added to the organic solvent.

Many devices have been suggested as to the apparatus for dispersing a dye. For example, U.S. Pat. No. 3,425,835 describes one such apparatus.

The method described in Japanese Patent Publication No. 24185/71 is economically disadvantageous since dispersion for a long period of time using a ball mill is required.

Also, in the method described in Japanese Patent Publication No. 27555/69, spectrally sensitizing dyes in general tend to be decomposed.

On the other hand, two or more spectrally sensitizing dyes in supersensitization with each other are used for spectrally sensitizing light-sensitive photographic emulsions, particularly color photographic emulsions.

Two or more spectrally sensitizing dyes can be separately added to a light-sensitive emulsion by separately dissolving the sensitizing dyes in different solutions. However, with dyes which supersensitize each other, superior photographic properties can be obtained by adding them as a mixed solution of two or more dyes than those obtained by separately adding them. It is well-known in this field that the light sensitivity tends to increase when the dyes are added as a mixed solution. However, when two or more sensitizing dyes are used as a mixed solution, often the defect occurs in that, upon dissolving in the same solvent, one of the dyes is quite unstable in the solvent and a rapid reduction in concentration during storage occurs.

Also, even when two or more dyes are stable in the same solvent, an undesirably large amount of solvent becomes necessary when at least one dye has a very poor solubility.

On the other hand, the dissolving of two or more dyes in the same solvent simplifies the production equipment. That is, only one vessel is necessary for stocking the solution, and the stocked solution can be fed as such upon addition to a light-sensitive photographic emulsion.

SUMMARY OF THE INVENTION

An object of the present invention is to provide an improved method for spectrally sensitizing a light-sensitive photographic emulsion with a spectrally sensitizing dye having an amidinium ion auxochrome.

Another object of the present invention is to provide an improved method for spectrally sensitizing a light-sensitive photographic emulsion with at least two spectrally sensitizing dyes having an amidinium ion auxochrome.

The above-described objects are attained by dissolving a photographic spectrally sensitizing dye having an amidinium ion auxochrome in an organic solvent containing a substantially water-free acid having a pKa (where Ka is the acid dissociation constant) not exceeding about 5 (in which the acid may contain water of crystallinity), and adding this dye-containing acid-organic solvent solution to a light-sensitive photographic emulsion. The pH of the light-sensitive emulsion is adjusted, previously or eventually, to a value sufficient to color the aforesaid spectrally sensitizing dyes.

DETAILED DESCRIPTION OF THE INVENTION

The term "amidinium ion auxochrome" as used herein in this specification is used in the broad sense as described in C. E. K. Mees; *The Theory of the Photographic Process*, p.373, 375 and 376, MacMillan Co. (1954).

Dyes having an amidinium ion auxochrome include cyanine dyes and hemicyanine dyes (including styryl dyes).

Typical useful cyanine dyes which can be used in the present invention are those represented by the following general formula [I]:

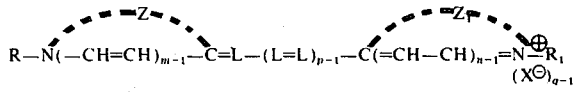

[I]

wherein $m$ and $n$ each represents 1 or 2; $p$ represents 1, 2 or 3; $q$ represents 1 or 2; L represents a methine group (which may be substituted with e.g., an alkyl group (e.g., methyl, ethyl, etc.), an aryl group (e.g., phenyl, etc.), etc.); Z and $Z_1$ each represents the non-metallic atoms necessary for completing a 5- or 6-membered nitrogen-containing heterocyclic ring nucleus. Suitable heterocyclic ring nuclei are a thiazole nucleus (e.g., thiazole, 4-methylthiazole, 4-phenylthiazole, 4,5-dimethylthiazole, 4,5-diphenylthiazole, etc.), a benzothiazole nucleus (e.g., benzothiazole, 4-chlorobenzothiazole, 5-chlorobenzothiazole, 6-chlorobenzothiazole, 7-chlorobenzothiazole, 5-nitrobenzothiazole, 6-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-chloro-6-nitrobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5 -phenylbenzothiazole, etc.); a naphthothiazole nucleus (e.g., naphtho[2,1-d]-thiazole, naphtho[1,2-d]thiazole, naphtho[2,3-d]-thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.)., a thiazoline nucleus (e.g., thiazoline, 4-methylthiazoline, 4-nitrothiazoline, etc.), an oxazole nucleus (e.g., oxazole, 4-methyloxazole, 4-nitrooxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluorobenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.), a naphthoxazole nucleus (e.g., naphtho[2,1-d]oxazole, naphtho[1,2-d]oxazole, naphtho[2,3-d]oxazole, 5-nitronaphtho[2,1-d]oxazole, etc.), a oxazoline nucleus (e.g., 4,4-dimethyloxazoline, etc.), a selenazole nucleus (e.g., 4-methylselenazole, 4-nitroselenazole, 4-phenylselenazole, etc.), a benzoselenazole nucleus (e.g., benzoselenazole, 5-chlorobenzoselenazole, 5 -nitrobenzoselenazole, 5-methoxybenzoselenazole, 5-hydroxybenzoselenazole, 6-nitrobenzoselenazole, 5-chloro-6-nitrobenzoselenazole, etc.), a naphthoselenazole nucleus (e.g., naphtho[2,1-d]selenazole, naphtho[1,2-d]selenazole, etc.), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3-dimethyl-5-methylindolenine, 3,3-dimethyl-5-chloroindolenine, etc.), an imidazole nucleus (e.g., 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyo-5-fluorobenzimidazole, 1-alkyl-5-trifluoromethylbenzimidazole, 1-alkylnaphtho[1,2-d]imidazole, 1-allyl-5,6-dichlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]imidazole, the alkyl moiety having preferably 1 to 8 carbon atoms (e.g., methyl, ethyl, propyl, isopropyl, butyl, or a like unsubstituted alkyl group, a hydroxyalkyl group (e.g., 2-hydroxyalkyl, 3-hydroxypropyl, etc.), and the like and the aryl being phenyl, halogen (e.g., chloro)-substituted phenyl, alkyl (e.g., methyl)-substituted phenyl, alkoxy (e.g., methoxy)-substituted phenyl, etc.), a pyridine nucleus (e.g., pyridine, 5 -methyl-2-pyridine, 3-methyl-4-pyridine, etc.), a quinoline nucleus (e.g., quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, 6-nitro-3-isoquinoline, etc.), an imidazo[4,5-b]quinoxaline nucleus (e.g., 1,3-diethylimidazo[4,5-b]quinoxaline, 6-chloro-1,3-diallylimidazo[4,5-b]quinoxaline, etc.), etc. X represents an inorganic or organic anion such as chloride, bromide, iodide, p-toluenesulfonate, methyl sulfate, ethyl sulfate, perchlorate, etc. R and $R_1$ each represents an alcohol residue such as an alkyl group having 1 to 18, preferably 1 to 7, carbon atoms [e.g., an unsubstituted alkyl group (e.g., methyl ethyl, propyl, isopropyl, butyl, hexyl, dodecyl, octadecyl, etc.), a substituted alkyl group (e.g., an aralkyl group (e.g., benzyl, β-phenylethyl, etc.), a hydroxyalkyl group (e.g., 2-hydroxyethyl, 3-hydroxypropyl, etc.), a carboxyalkyl group (e.g., 2-carboxyethyl, 3-carboxypropyl, 4-carboxybutyl, etc.), a sulfosubstituted alkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethyoxyethyl, etc.), a sulfatoalkyl group (e.g., 3-sulfatopropyl, 4-sulfatobutyl, etc.))]. When $q$ represents 1, the dye forms a betaine-type structure.

Specific examples of the cyanine dyes which can be used in the present invention include the following dyes.

Dye 1-1
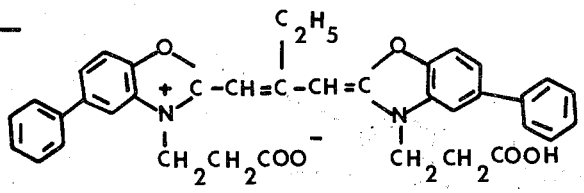
Dye 1-2
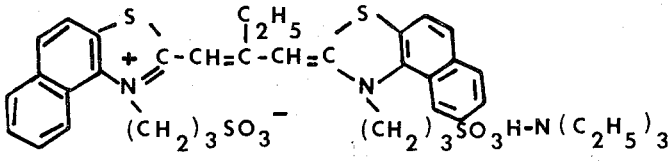
Dye 1-3
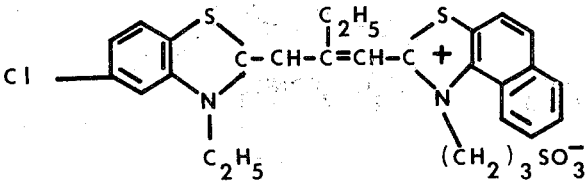
Dye 1-4
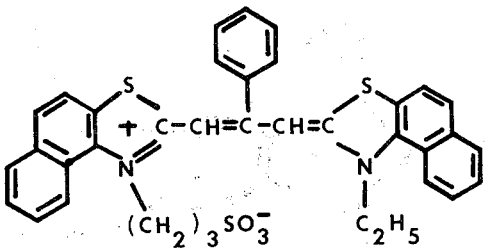
Dye 1-5
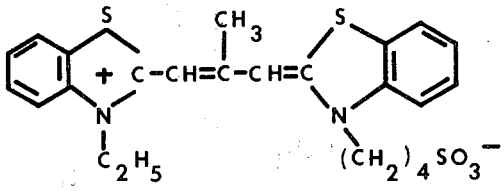
Dye 1-6
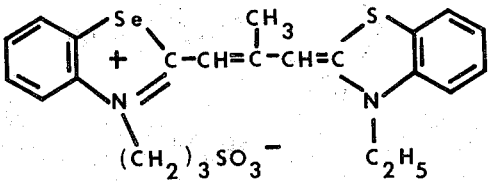
Dye 1-7
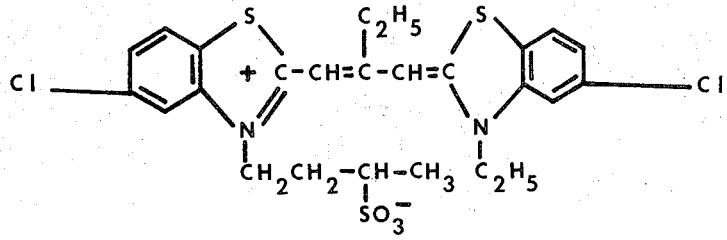

Dye 1-14
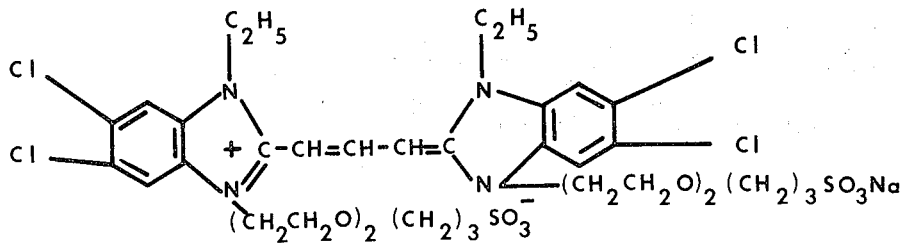
Dye 1-15
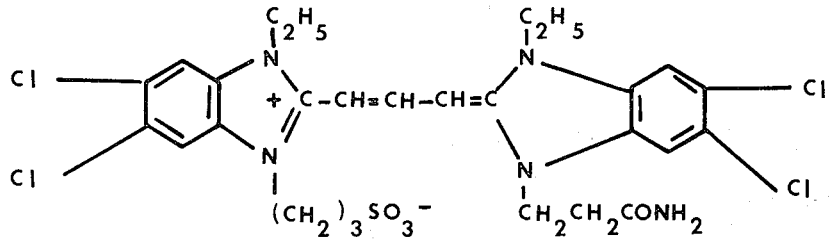
Dye 1-16
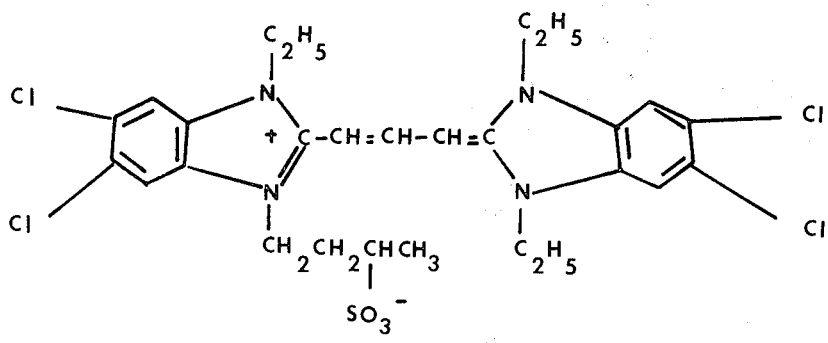
Dye 1-17
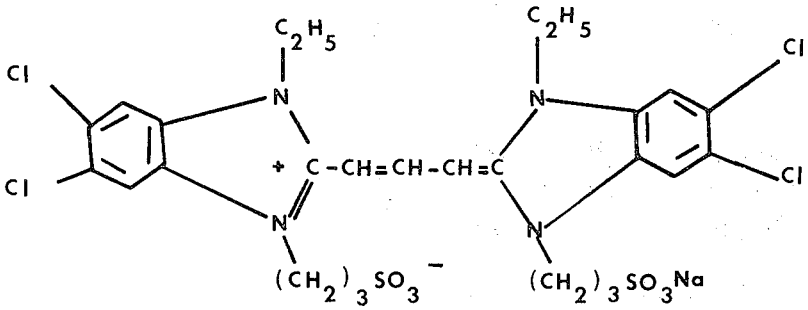
Dye 1-18
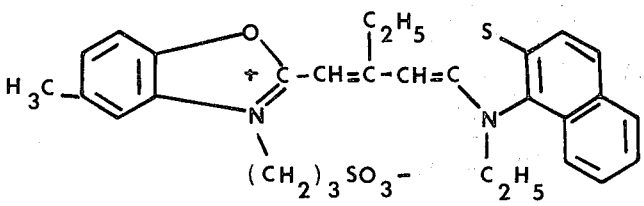

Dye 1-8
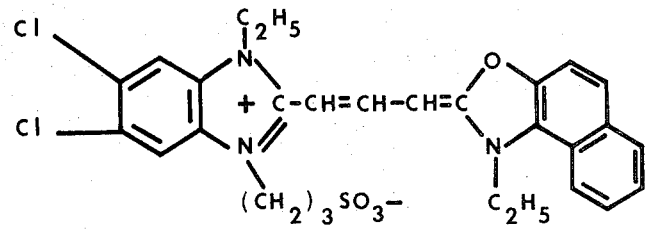
Dye 1-9
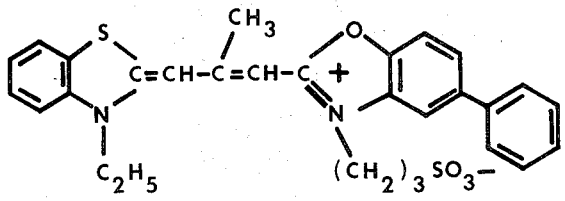
Dye 1-10
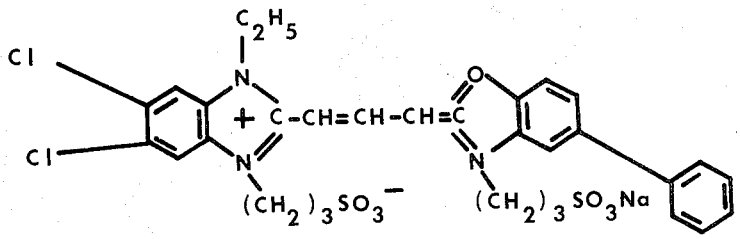
Dye 1-11
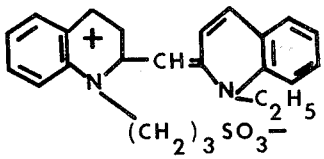
Dye 1-12
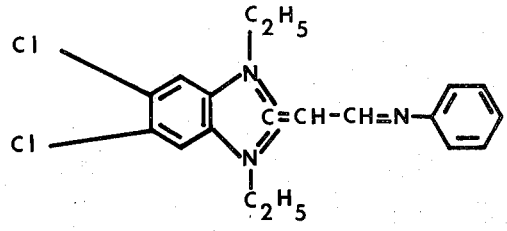
Dye 1-13
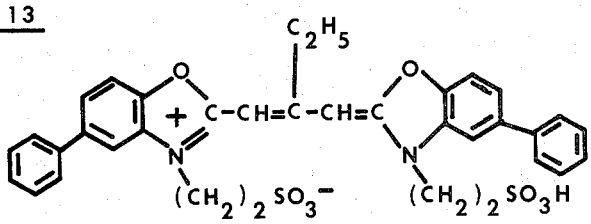

Dye 1-19

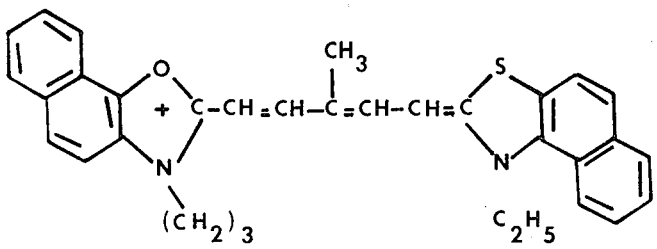

Dye 1-20

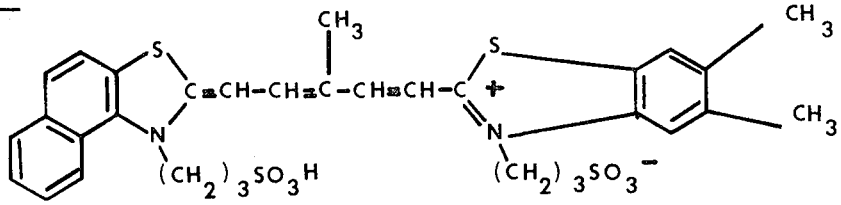

Dye 1-21

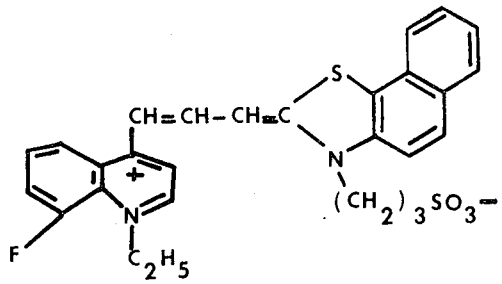

Dye 1-22

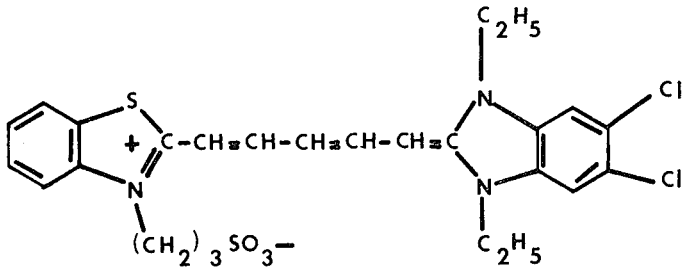

Dye 1-23

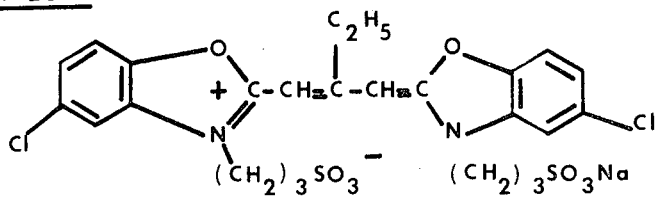

Typical hemicyanine dyes which can be used in the present invention are represented by the following general formula [II]:

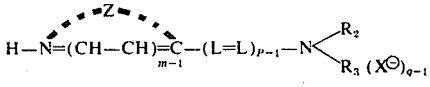

[II]

wherein R, X, Z, L, *m*, *p* and *q* are the same as defined in general formula [I]. Two L moieties can be connected to each other to form a 5- to 7-membered aromatic ring (e.g., benzene ring, etc.). $R_2$ and $R_3$ each represents a hydrogen atom, an alcohol residue, defined with respect to R in the general formula [I], or an aryl group (e.g., phenyl, alkyl (e.g., methyl)-substituted phenyl, alkoxy (e.g., methoxy)-substituted phenyl, halogen (e.g., chloro)-substituted phenyl, naphthyl, etc.) or, when taken together, $R_2$ and $R_3$ represent the atoms necessary to form a ring such as 5- or 6-membered nitrogen-containing heterocydic ring nucleus (e.g., pyridine, morpholine or pyrazolidine). Typical examples of hemicyanine dyes which can be used in the present invention are represented by the following structural formulae:

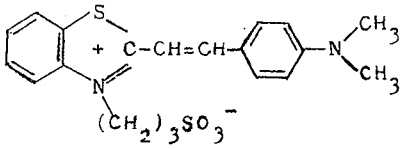

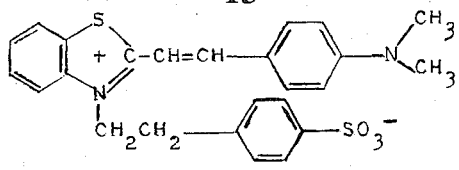

Acids suitable for the present invention are those which do not substantially contain water (i.e. containing not more than about 10 percent by weight, preferably not more than 5 percent by weight), can be dissolved in organic solvents and are preferably freely miscible with water. Specific examples of suitable acids, are organic acids (aliphatic acids and aromatic acids) and inorganic acids. Organic acids having at least one sulfo group, one sulfate group, one enolic hydroxy group or the combination thereof, and the like are employed. More specifically, methanesulfonic acid, ethanesulfonic acid, 2-propanesulfonic acid, 1,2-ethanedisulfonic acid, benzenesulfonic acid, p-benzenedisulfonic acid, p-toluenesulfonic acid, naphthalene-α-sulfonic acid; barbituric acid, thiobarbituric acid; anhydro-2-methyl-5,6-dichloro-1,3-di(3-sulfopropyl)benzimidazole hydroxide, anhydro-2-methyl-5-chloro-1,3-di(3-sulfopropyl)benzimidazole hydroxide; acidic surface active agents having a sulfo or sulfate group; phosphoric acid, nitric acid; and the like are suitable. Particularly preferred acids are organic acids such as methanesulfonic acid, thiobarbituric acid, etc.

It is difficult to specify the acid concentration of the acid in an organic solvent unequivocally because the concentration varies depending upon the kind of the dye used. However, the concentration of the acid is preferably not more than about 10 percent by weight. Generally, a preferred molar ratio of the acid to the dye ranges from about 1:1 to about 20:1.

Suitable organic solvents which can be used in the present invention are those which are miscible with water (preferably freely miscible with water) such as alcohols (e.g., methanol, ethanol, methyl cellosolve, etc.), ketones (e.g., acetone, etc.), known as organic solvents for additives of photographic emulsions.

The pH of the emulsion, although not particularly of concern, can be adjusted, if desired, e.g., preferably to a pH of about 5 to 9 after adding the organic solution containing the dye and the acid to the emulsion. The pH of the emulsion can be adjusted by adding organic or inorganic bases (e.g., alkali metal hydroxides such as sodium hydroxide, potassium hydroxide, etc., alkali metal carbonates such as sodium carbonate, sodium hydrogen carbonate, etc., organic amines such as pyridine, triethylamine, etc.).

A first aspect of the present invention is that dyes which are slightly soluble in an ordinary solvent such as methanol or ethanol can be easily dissolved in an organic solvent containing a substantially water-free acid, i.e., the solubility of dyes is markedly improved by adding the acid to an organic solvent. Therefore, a much smaller amount of organic solvent is necessary for dissolving the dyes as compared with the case of using an organic solvent alone. Thus, the advantage is provided that difficulties due to the organic solvent upon high speed coating can be removed in the case of coating a photographic silver halide emulsion on a support.

A second aspect of the present invention lies in the acid-containing organic solvent capable of dissolving a mixture of two or more dyes in that the resulting solution can be stored with good stability. For example, when one dye is dissolved in an acidic aqueous solution and another dye is dissolved in an aqueous solution of a pH of 7 as described in U.S. Pat. No. 3,585,195, followed by mixing them and adding the mixture to an emulsion, the former dye tends to be precipitated while the latter dye tends to be decomposed. Thus, difficulties can occur in the production of a silver halide photographic emulsion.

However, in the method of the present invention in which an organic solvent containing a substantially water-free acid is used, a solution of a mixture of two dyes can be prepared and the stability of the thus prepared solution with the lapse of time is advantageous.

A third aspect of the present invention is that, in dissolving a dye slightly soluble in an organic solvent and water by adding an acid, the method of the present invention of dissolving an acid in an organic solvent enables dissolution using a lower amount of acid as compared with the case of adding an acid to water. Therefore, the pH of the light-sensitive emulsion is scarcely changed by the addition of the dye solution or, if changed, the pH can be adjusted with a small amount of base, which is advantageous from the viewpoint of the protective colloidal property of gelatin and the photographic properties. Also, the migration by diffusion of spectrally sensitizing dyes to other layers due to excess solvent can be prevented.

A fourth aspect of the present invention is the use of a substantially water-free, organic solvent-soluble acid. Acids are desirably used in an amount as small as possible. The kind and the amount thereof are selected so that the photographic properties are not detrimentally influenced.

The light-sensitive emulsion which can be used is a hydrophilic colloid containing dispersed therein fine crystals of a light-sensitive element such as light-sensitive silver halide, titanium oxide, zinc oxide, cadmium sulfide, etc. Of these, a gelatino-silver halide emulsion is preferably used. Any of silver bromoiodide, silver bromide, silver chlorobromide, silver chloride, silver chlorobromoiodide, etc., can be used as the silver halide.

Chemical ripening which is conducted if desired can be effected using methods well-known in the art using reduction sensitization as disclosed in U.S. Pat. Nos. 2,518,498, 2,419,974, 2,983,410, etc.; sulfur sensitization; as disclosed in U.S. Pat. Nos. 1,574,944, 2,278,947, 2,440,206, 2,410,689; gold sensitization as disclosed in U.S. Pat. Nos. 2,540,085, 2,597,876, 2,597,915, 2,399,083, etc. noble metal sensitization or a combination thereof. Specific chemical sensitizing agents include sulfur sensitizers such as allylthiocarbamide, thiourea, sodium thiosulfate, cystine, etc.; noble metal sensitizers such as potassium chloroaurate, aurous thiosulfate, potassium chloropalladate, etc.; reduction sensitizers such as tin chloride, phenylhydrazine, reductone, etc. Polyoxyethylene derivatives (British Pat. No. 981,470, Japanese Pat. Publication No. 6475/56, U.S. Pat. No. 2,716,062, etc.), polyoxypropylene derivatives, derivatives having a quaternary ammonium group, etc. can be included in the emulsion. The sensitization is useful regardless of the degree and the kind thereof. The present invention is applicable to light-sensitive emulsions to which spectral sensitization is effective.

As the hydrophilic colloid to be used for photographic emulsions, those substances which do not detrimentally influence the light-sensitive silver halide, such as albumin, agar-agar, gum arabic, acylated gelatin (e.g., phthaloylated gelatin, malonoylated gelatin, etc.), hydrophilic polymers (e.g., polyvinyl alcohol, polyvinyl pyrrolidone, polyacrylamide, polystyrenesulfonic acid, etc.), cellulose derivatives (e.g., hydroxyethyl cellulose, carboxymethyl cellulose, dextrin, etc.) water-soluble starch, etc. can be used as well as gelatin.

The light-sensitive emulsion used can contain a suitable antifoggant or a stabilizer. For example, the thiazolium salts as described in U.S. Pat. Nos. 2,131,038, 2,694,716, etc.; the azaindenes as described in U.S. Pat. Nos. 2,886,437, 2,444,605, etc.; the urazoles as described in U.S. Pat. No. 3,287,135, etc.; the sulfocatechols as described in U.s. Pat. No. 3,236,652, etc.; the oximes as described in British Pat. No. 623,448, etc.; the mercaptotetrazoles as described in U.S. Pat. Nos. 2,403,927, 3,266,897, 3,397,987, etc.; nitrons; nitroindazoles; the polyvalent metal salts as described in U.S. Pat. No. 2,839,405, etc.; the thiuronium salts as described in U.S. Pat. No. 3,220,839, etc.; the salts of palladium, platinum and gold as described in U.S. Pat. Nos. 2,566,263, 2,597,915, etc.; and the like can be employed.

The light-sensitive emulsion to be used can contain coating aids such as saponin, alkylaryl sulfonates, the amphoteric compounds as described in U.S. Pat. No. 3,1 3,816, etc.

The light-sensitive emulsion used can contain an antistatic agent, a plasticizer, a fluorescent brightening agent, a development accelerator, an anti-aerial fogging agent, a toning agent, etc.

The color couplers to be incorporated can be the couplers described in U.S. Pat. Nos. 3,311,476, 3,006,759, 3,277,155, 3,214,437, 3,253,924, 2,600,788, 2,801,171, 3,252,924, 2,698,794, 2,474,293, British Pat. No. 1,140,898, etc.

Also, suitable irradiation-preventing dyes incorporated can be those described in, e.g., Japanese Pat. Publication Nos. 20389/66, 3504/68, 13168/68, U.S. Pat. Nos. 2,697,037, 3,423,207, 2,865,752, British Pat. Nos. 1,030,392, 1,100,546, etc.

The finished emulsion spectrally sensitized by the present invention is coated on a suitable support such as a cellulose derivative film, a polyethylene terephthalate film, a baryta paper, a paper, a resin-laminated paper, a synthetic paper, a glass plate, a plastic film, a metal plate, etc.

The method for spectral sensitizing of the present invention can be employed in combination with a commonly used method or a supersensitizing method.

Spectrally sensitizing dyes are used in an amount conventionally employed for a light-sensitive element (e.g., silver halide). More specifically, an amount of about $1 \times 10^{-6}$ mol to $1 \times 10^{-3}$ mol per 1 mol of silver halide is preferred.

The spectrally sensitizing method of the present invention can be employed in combination with a conventionally used spectrally sensitizing method, the method as described in U.S. Pat. application Ser. No. 524,184, filed on Nov. 15, 1974, a conventionally employed supersensitizing method, or with the supersensitizing method as described in U.S. Pat. application Ser. No. 523,680, filed on Nov. 13, 1974.

As to the proportion of the spectrally sensitizing dye and the supersensitizing agent, a conventional "supersensitizing proportion" can be employed. This proportion can be appropriately decided by those skilled in the art based on common knowledge and experience. As one example, the supersensitizing agent can be used in an amount several times to several tens of times (by weight) or, in some cases, several hundred times the amount of dye used.

In the case of supersensitization using spectrally sensitizing dyes, the proportion can be selected in the range of about 1:10 to 10:1 by weight of one sensitizing dye to the other sensitizing dye.

Silver halide (of either an ordinary grain size or fine grain size) in the photographic emulsion used in the present invention can be prepared using conventional methods such as a single jet method, a double jet method or a combination thereof, Methods for preparing a silver halide emulsion are described in, e.g., Trivelli & Smith; *The Photographic Journal*, Vol. 79, pp. 330 – 338 (1939), C. E. K. Mees; *The Theory of Photographic Process*, MacMillan, Glafkidis; *Photographic Chemistry*, Vol. I, pp. 327 – 336 (Fountain Press), and the like.

The light-sensitive emulsion of the present invention can be used for various light-sensitive materials. The emulsion can be used as an emulsion for color positives, an emulsion for color papers, an emulsion for color negatives, an emulsion for color reversal (containing or not containing couplers) materials, an emulsion for photographic light-sensitive materials for plate-making (e.g., lith films, etc.), an emulsion for a light-sensitive material for cathode ray tube display, an emulsion for a light-sensitive material for recording X-rays (particularly materials for use in direct or indirect photographing using an intensifying screen), an emulsion to be used for the colloid transfer process (as described in, e.g., U.S. Pat. No. 2,716,059), an emulsion for use in the silver salt diffusion transfer process (as described in, e.g., U.S. Pat. Nos. 2,352,014, 1,543,181, 3,020,155, 2,861,885, etc.), an emulsion for use in the color diffusion transfer process (as described in, e.g., U.S. Pat. Nos. 3,087,817, 3,185,567, 2,983,606, 3,253,915, 3,227,550, 3,227,551, 3,227,552, 3,415,644, 3,415,645, 3,415,646, etc.), an emulsion for use in the inhibition transfer process (as described in U.S. Pat. No. 2,882,156, etc.), an emulsion for use in the silver dye bleaching process (as described in, e.g., Friedman, *History of Color Photography*, (particularly Chapter 24 American Photographic Publishers Co., (1944), *British Journal of Photography*, Vol. III, pp. 308 – 309, Apr. 7, 1964, etc.), an emulsion for a print-out image-recording material (as described in, e.g., U.S. Pat. No. 2,369,449, Belgian Pat. No. 704,255, etc.), an emulsion for a direct print image light-sensitive material (as described in, e.g., U.S. Pat. Nos. 3,033,682, 3,287,137, etc.), an emulsion for a thermally developable light-sensitive material (as described in, e.g., U.s. Pat. Nos. 3,152,904, 3,312,550, 3,148,122, British Pat. No. 1,110,046, etc.), an emulsion for a light-sensitive material for physical development (as described in, e.g., British Pat. Nos. 920,277, 1,131,238, etc.), an emulsion for direct positive materials (as described in, e.g., U.S. Pat. Nos. 2,497,875, 2,541,472, 3,367,778, 3,501,309, 3,501,310, 3,505,070, 3,531,290, 3,501,305, 3,501,306, 3,501,307, 3,501,312, 3,510,348, British Pat. Nos. 1,186,711, 1,186,712, 1,186,713, etc.), and the like, as well as an emulsion for a black-and-white light-sensitive material.

The following examples are given to illustrate the present invention in greater detail. Unless otherwise indicated, all parts, percents, ratios and the like are by weight.

EXAMPLES 1

The solubility of 19.5 mg of aforesaid Dye 1–15 in 30 ml of an acid-containing solvent was examined to compare an aqueous solution with the methanol solution in accordance with the present invention. As the acid, methanesulfonic acid was used. The results thus obtained are shown in Table 1 below.

Table 1

| Solvent | Amount of Acid Added to Solvent | | Solubility of Dye | Note |
|---|---|---|---|---|
| Methanol | Methanesulfonic Acid | 0.54 ml | Soluble | Present Invention |
| Water | " | 0.54 ml | Insoluble | Comparison |
| Water | " | 5 ml | Soluble | " |

From the results in Table 1, it is clear that the methanesulfonic acid-containing methanol solution can dissolve the dye with the help of less of the acid as compared with the acid-containing aqueous solution.

When each of the dye solutions described above was added to 1 Kg of an emulsion (AgI:AgBr = 7:93 (molar ratio)) and the pH was adjusted to that of the original emulsion (about 6), about the same photographic properties (sensitivity, fog) were obtained.

EXAMPLE 2

15 mg of the aforesaid Dye I-14 was dissolved in 15 ml of a methanol solution containing methanesulfonic acid.

Separately, 90 mg of the aforesaid Dye I-23 was dissolved in 45 ml of methanol.

The solution of Dye I-14 was mixed with the solution of Dye I-23 (the amount of methanesulfonic acid added to the solvent (methanol) being 2 mol per 1 mol of Dye I-14) and the mixed solution was allowed to stand to examine the storability of the solution.

The change in the absorption density of Dye I-23 (retention ratio) was 97% (after 24 hours).

The above-described mixed solution was added to the same gelatino-silver bromoiodide emulsion as used in Example 1 and, after adjusting the pH, the resulting emulsion was coated on a cellulose triacetate support.

Separately, the same amount of Dye I-14 was dissolved in an aqueous solution containing the same amount of methanesulfonic acid.

On the other hand, the same amount of Dye I-23 was dissolved in water, followed by adjusting the pH to 7.0.

When the aqueous solution of Dye I-14 was mixed with the aqueous solution of Dye I-23 and the resulting mixture solution was allowed to stand as described above, the absorption of Dye I-23 was markedly reduced (not more than 10%) after 24 hours. When this mixed solution was added to the same gelatino-silver bromoiodide emulsion, a quite low sensitivity (not more than ¼ that obtained with the present invention) was obtained.

While the invention has been described in detail and with reference to specific embodiments thereof, it will be apparent to one skilled in the art that various changes and modification can be made therein without departing from the spirit and scope thereof.

What is claimed is:

1. A method for spectrally sensitizing a photographic light-sensitive silver halide emulsion, which comprises dissolving a photographic spectrally sensitizing dye having an amidinium ion auxochrome in an acid-containing organic solvent solution consisting essentially of a water-miscible organic solvent and not more than 10% by weight of an acid having a pKa not exceeding about 5 and being substantially free of water, and adding said solution to a light-sensitive silver halide emulsion.

2. The method for spectrally sensitizing a photographic light-sensitive silver halide emulsion as described in claim 1, wherein said photographic spectrically sensitizing dye having an amidinium ion auxochrome is represented by the following general formula (I):

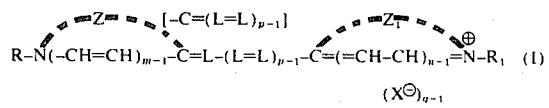

(I)

wherein $m$ and $n$ each represents 1 or 2; $p$ represents 1, 2 or 3; $q$ represents 1 or 2; L represents a methine group; Z and $Z_1$ each represents the atoms necessary to complete a 5- or 6-membered nitrogen-containing heterocyclic nucleus; X represents an acid anion; and R and $R_1$ each represents an alcohol residue.

3. The method for spectrally sensitizing a photographic light-sensitive, silver halide emulsion as described in claim 2, wherein said dye-containing acid-organic solvent solution contains at least two of the dyes represented by the general formula [I].

4. The method for spectrally sensitizing a photographic light-sensitive, silver halide emulsion as described in claim 1, wherein said substantially water-free acid is methanesulfonic acid or ethanesulfonic acid.

5. The method for spectrally sensitizing a photographic light-sensitive silver halide emulsion as described in claim 1, wherein said acid cotains not more than 10 percent by weight water of crystallinity.

* * * * *